US006729654B2

(12) United States Patent
Takemura

(10) Patent No.: US 6,729,654 B2
(45) Date of Patent: May 4, 2004

(54) PRINT PRODUCING SYSTEM AND PRINTS

(75) Inventor: Koji Takemura, Tokyo (JP)

(73) Assignee: Konica Corporation, Tokyo (JP)

( * ) Notice: Subject to any disclaimer, the term of this patent is extended or adjusted under 35 U.S.C. 154(b) by 292 days.

(21) Appl. No.: 09/808,600

(22) Filed: Mar. 14, 2001

(65) Prior Publication Data

US 2001/0025467 A1 Oct. 4, 2001

(30) Foreign Application Priority Data

Mar. 21, 2000 (JP) ..... 2000-077893

(51) Int. Cl.[7] ..... B42D 15/00

(52) U.S. Cl. ..... 283/70; 412/1; 707/202; 707/1

(58) Field of Search ..... 358/442, 403, 358/408, 527; 707/202; 283/67, 70; 412/1

(56) References Cited

U.S. PATENT DOCUMENTS 6,304,345 B1 * 10/2001 Patton et al. ..... 358/327
6,324,545 B1 * 11/2001 Morag ..... 707/202
6,362,900 B1 * 3/2002 Squilla et al. ..... 358/42

* cited by examiner

*Primary Examiner*—Willmon Fridie, Jr.
(74) *Attorney, Agent, or Firm*—Frishauf, Holtz, Goodman & Chick, P.C.

(57) ABSTRACT

There is described a system for producing prints based on digital image data and for packing the prints. The system includes an inputting section to input a plurality of print-order information including customer-identifying information for identifying each of customers and a print-producing section to produce the prints based on digital image data corresponding to the print-order information. The prints includes a first print including the customer-identifying information and second prints including objective images, and the prints are arranged in such an order that the first print is disposed at an uppermost position of the prints while the second prints are disposed under the first print, when a printed surface of each of the prints is regarded as an upward surface.

12 Claims, 4 Drawing Sheets

PRINT PRODUCING SYSTEM AND PRINTS

BACKGROUND OF THE INVENTION

This invention relates to a print producing system and prints.

In recent years, thanks to the diffusion of personal computers (hereinafter referred to as PC's) and the internet technology, the frequency of the cases where printing of images taken by a digital camera (hereinafter referred to as a DC), images made by a customer for himself, and a postcard, etc. are ordered by using the internet is increasing. In most cases concerning the above, the delivery of finished goods is carried out by sending them to the customers' home or the like.

On the other hand, also in the field of the reception of orders heretofore practiced, it has sometimes occurred the case where persons, who have their home at a distant place, or are busy about their task and have no time to spare, make only the procedure of the order reception at the shop front, and have the finished goods sent by mail. Especially, in vast lands such as America and Australia, the above-mentioned way has rather become the main current because it is very difficult to come twice to the shop front. Further, in the case where postcards etc. are ordered to an external large laboratory or the like which practices concentrated processing, there is a service such that the delivery is made by mail directly from the large laboratory as soon as the processing is completed, because the delivery time can not be foreseen.

However, in the present state, for example, in the case where the order reception is made in a mini-laboratory or the like, the customer information which is necessary for mailing such as the name and the address is written down on the DP-sack or the like at first, and after the prints are finished and the packing operation is done, the customer information on the DP-sack is transferred onto the pack of the prints, which are delivered by mail. In this case, it is often produced such a trouble that wrong prints are contained or a mistake of transfer is made.

Therefore, there has been a method in which the customer information is inputted in a PC beforehand prior to the practice of printing, and a seal print made by a printer for home-use or the like is pasted on the packing sack, or some other one like this, but the above-mentioned troubles such as the putting-in of wrong prints have not been solved by it as yet, and moreover, it increases cost. On top of it, operators must take attention in checking the content of the sack and confirming the address, which extremely lowers the efficiency of operation. In order to solve this problem, it has been proposed a system in which the operations of inputting the customer information, packing, and pasting the address are fully automated; however, it takes a considerable cost for introducing the equipment, and the pasting operation has to be done manually after all; therefore, it can not be regarded as a very good system.

SUMMARY OF THE INVENTION

To overcome the abovementioned drawbacks in conventional print-producing systems, it is an object of the present invention to provide a print-producing system and a print product, which make it possible to reliably deliver the prints to customers in more efficient and simpler process than ever.

Accordingly, to overcome the cited shortcomings, the abovementioned object of the present invention can be attained by a print-producing system and a print product described as follow.

(1) A system for producing prints based on digital image data and for packing the prints, comprising: an inputting section to input a plurality of print-order information including customer-identifying information for identifying each of customers; and a print-producing section to produce the prints based on digital image data corresponding to the print-order information; wherein the prints comprise a first print including the customer-identifying information and second prints including objective images, and the prints are arranged in such an order that the first print is disposed at an uppermost position of the prints while the second prints are disposed under the first print, when a printed surface of each of said prints is regarded as an upward surface.

(2) The system of item 1, wherein the order of the first print and the second prints is obtained by controlling a printing order of the prints.

(3) The system of item 1, wherein the print-producing section comprises a first print-producing part for producing the first print and a second print-producing part for producing the second prints, and the order of the prints is obtained by controlling a printing order of the first print-producing part and the second print-producing part.

(4) The system of item 3, wherein the first print-producing part produces the first print after the second print-producing part produces the second prints, and the first print is discharged in such a manner that a printed surface of the first print faces upward.

(5) The system of item 1, wherein the prints, produced by the print-producing section, include an index print, which is arranged in the order of the prints so that the index print is disposed between the first print and the second prints.

(6) The system of item 1, wherein a size of the first print is larger than a size of the second prints including the objective images.

(7) The system of item 1, wherein the first print includes color-identifying information for identifying each of the customers.

(8) The system of item 1, wherein the customer-identifying information, for identifying each of the customers, include at least one of an address, a name, a postal code number, a telephone number of each of the customers, an ID number for identifying each of the customers and/or each of the print-order information, and a bar code for identifying each of the customers and/or each of the print-order information.

(9) The system of item 1, wherein at least one of items selected from an address, a name, a postal code number, a telephone number, and an ID number of a sender is written on the first print.

(10) The system of item 1, wherein the same image-forming apparatus records images on the first print and the second prints.

(11) The system of item 1, further comprising: a packing section to pack the prints, arranged in the order by the print producing section, in such a manner that a printed surface of the first print can be recognized by human eyes.

(12) The system of item 1, wherein the prints include a printed receipt on which billing information are written.

(13) A print product, in which prints, produced based on digital image data corresponding to print-order information including customer-identifying information for identifying each of customers, are packed to send it to each of the customers, characterized in that the prints comprise a first print including the customer-identifying information and second prints including objective images, and the prints are arranged in such an order that the first print is disposed at an uppermost position of the prints while the second prints are disposed under the first print, when a printed surface of each of said prints is regarded as an upward surface.

(14) The print product of item 13, wherein a size of the first print is larger than a size of the second prints.

(15) The print product of item 13, wherein the first print includes color-identifying information for identifying each of the customers.

(16) The print product of item 13, wherein the customer-identifying information, for identifying each of the customers, include at least one of an address, a name, a postal code number, a telephone number of each of the customers, an ID number for identifying each of the customers and/or each of the print-order information, and a bar code for identifying each of the customers and/or each of the print-order information.

(17) The print product of item 13, wherein at least one of an address, a name, a postal code number, a telephone number, and an ID number of a sender, is written on the first print.

(18) The print product of item 13, wherein the same image-forming apparatus records images on the first print and the second prints.

(19) The print product of item 13, wherein the print product is packed in such a manner that a printed surface of the first print can be recognized by human eyes.

Further, to overcome the abovementioned problems, other print-producing systems, embodied in the present invention, will be described as follow:

(20) A print producing system comprising the processes of printing digital image data from a plurality of bits of print order information including the customer identifying information and packing the obtained prints, wherein the order of arrangement of the prints packed by said print producing system, with the print recording surfaces made upside, is such one that the print including the customer identifying information for identifying the customer comes to the uppermost position of the prints.

By making such a structure, it is possible to make the uppermost print include the customer identifying information, which makes it possible to pack the prints as they are in the packing process; therefore, the print packing process is shortened, and the system is convenient.

(21) A print producing system comprising the processes of printing digital image data from a plurality of bits of print order information including the customer identifying information and packing the obtained prints, said print producing system further comprising a print image forming process for printing an image from said print order information, wherein the order of arrangement of the prints obtained by said print image forming process, with the print recording surfaces made upside, is such one that the print including the customer identifying information for identifying the customer comes to the uppermost position of the prints.

By making such a structure, it is possible to make the uppermost print include the customer identifying information, which makes it possible to pack the prints as they are in the packing process; therefore, the print packing process is shortened, and the system is convenient.

(22) A print producing system comprising the processes of printing digital image data from a plurality of bits of print order information including the customer identifying information and packing the obtained prints, said print producing system further comprising a print image forming process for printing an image from said print order information, wherein the prints obtained by said print image forming process are comprised of a print including the customer identifying information for identifying the customer, a print including the objective image which the customer has ordered, and an index-print, and the order of arrangement of the prints, with the print recording surfaces made upside, is such one that the print including the customer identifying information for identifying the customer comes to the uppermost position of the prints, the next is the index-print, and the next further and under are the image prints including the objective image.

By making such a structure, it is possible to make the uppermost print include the customer identifying information, which makes it possible to pack the prints as they are in the packing process; therefore, the print packing process is shortened, and the system is convenient. Further, because the index-print is placed next to the customer identifying information, the whole of the images can be quickly grasped.

(23) A print producing system comprising the processes of printing digital image data from a plurality of bits of print order information including the customer identifying information and packing the obtained prints, wherein the prints packed by said print producing system are comprised of a print including the customer identifying information for identifying the customer, a print including the objective image which the customer has ordered, and an index-print, and the order of arrangement of the prints, with the print recording surfaces made upside, is such one that it is placed at the topmost the print including the customer identifying information for identifying the customer, the next is the index-print, and the next further and under are the image prints including the objective image.

By making such a structure, it is possible that the topmost print includes the customer identifying information, which makes it possible to pack the prints as they are in the packing process; therefore, the print packing process is shortened, and the system is convenient. Further, because the index-print is placed next to the customer identifying information, the whole of the images can be rapidly grasped.

(24) Prints having images printed from digital image data on the basis of a plurality of bits of information including the customer identifying information, and being sent to the customer after packing [the obtained prints], said prints having at least one of the bits of the customer identifying information which indicates the identification of the customer.

By making such a structure, because the prints have the customer identifying information, the address information of the customer can be quickly obtained.

(25) A Print producing system wherein the print size of the print including the aforesaid customer identifying information for identifying the customer is larger than the print size of the image print including the objective image.

By making such a structure, in packing the prints, it can be done well, and by inserting a print identifying the customer for every order for example, the groups of the prints can be recognized for the respective orders.

(26) A print producing system wherein the aforesaid print including the customer information for identifying the customer includes identification color information for identifying the customer.

By making such a structure, the customer identifying information can be recognized more clearly.

(27) A print producing system wherein the aforesaid customer identifying information for identifying the customer is at least one of the address, the name, the postal code number, the telephone number of the customer, the ID number for identifying the customer and/or the order, the bar code for identifying the customer and/or the order.

By making such a structure, the recognition of the customer can be reliably done.

(28) A print producing system wherein, on the print on which the aforesaid customer identifying information is recorded, at least one selected from the address, name, postal code, telephone number, and ID number of the sender is also recorded.

By making such a structure, the recognition of the customer can be reliably made.

(29) A print producing system wherein the image print including the objective image which the customer has ordered and the print including the customer identifying information for identifying the customer are produced by the same image forming apparatus.

By making such a structure, in addition to the image information, the customer identifying information can be recorded by the same image forming apparatus, which makes the system convenient.

(30) A print producing system wherein the way of packing in the aforesaid packing process, with the recording surface made upside, is such one that print on which the customer identifying information is recorded can be visually confirmed.

By making such a structure, because the customer identifying information can be visually confirmed, the address of the customer can be easily recognized.

(31) Prints wherein a receipt print presenting the billing information is included in the prints packed by the aforesaid print producing system.

By making such a structure, the billing information can be known from the receipt print

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
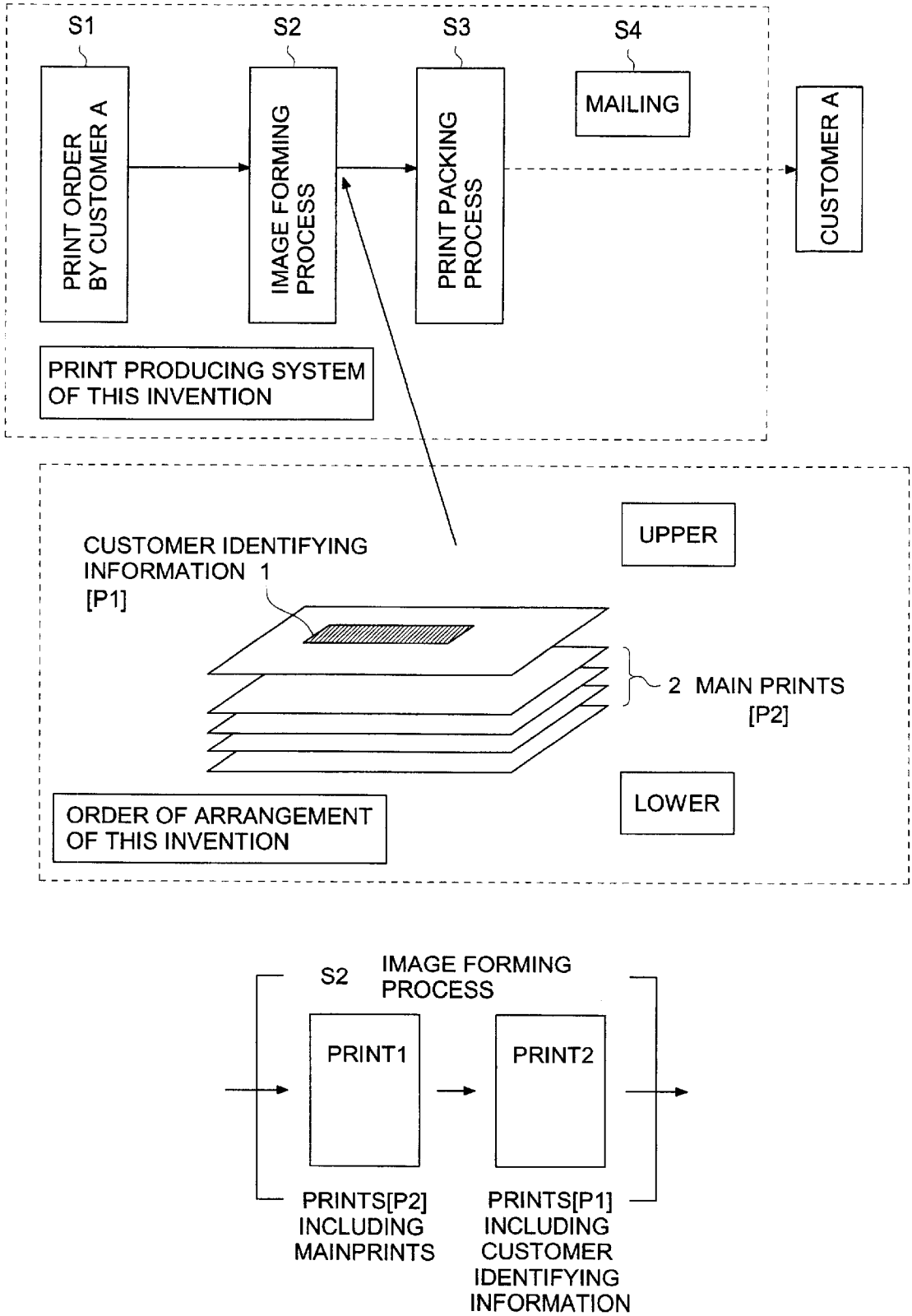
FIG. 1 is a drawing showing an example of the embodiment of a print system of this invention.

In the following, examples of the embodiment of this invention will be explained in detail by referring to the drawings.

FIG. 1 is a drawing showing an example of the embodiment of a print system of this invention. In the drawing, S1 denotes the print order process of the customer A, S2 denotes the image forming process for forming an image in response to said print order process, S3 denotes the print packing process for packing prints on which an image is formed, and S4 denotes the mailing process for sending the packed prints to the customer A by mail.

The customer A carries out the print order S1. Two cases can be considered for making a print order; one is the case where the customer A brings the film on which images are recorded or the image data taken by a DC, and the other is the case where the customer A requires printing by transmitting image data through the internet from the terminal of the PC which he has.

In this specification, a film on which images are recorded means an undeveloped film or a developed film on which images taken by a customer are recorded, or in other words, what is called a negative film or a reversal film of silver halide photographic photosensitive material. In this case, at the time of receiving an order from the customer A, the customer identifying information for identifying the customer must be obtained. For example, in the case where the content of the order is a negative film or a reversal film as mentioned above, or digital image data taken by a DC, the customer identifying information for identifying the customer means not only the name of the customer but also the telephone number, postal code number, address, etc. of the customer, and they are obtained by asking the customer A about them and transferring them by the person who has received the order, or by directly writing them in a form by the customer A himself. Further, if the above-mentioned customer identifying information is controlled as a customer database in correspondence with the customer ID information, only by requesting the customer to bring a card in which the customer ID is written at the time of order reception, the customer identifying information can be automatically obtained through reading the customer ID. In this case, by making the customer ID etc. a bar code or the like, operation can more efficiently proceed. The information including the customer ID and the bar code or the like is called the customer identifying information. Further, in the case where the customer A issues an order directly through the internet, it is also possible to obtain the above-mentioned customer identifying information by making them inputted from the terminal at the home of the customer A.

In the image forming process S2, in response to the requirement for image-printing, image formation starts corresponding to the customer identifying information. In said image forming process S2, an image forming apparatus is used. An image forming apparatus herein referred to means an apparatus having a function to produce digital image data, and it mostly means an apparatus having a function to output a print of digital image data. It is desirable that, in addition to the above, this image forming apparatus have a function to read an image, a function to process image data, a function to read out image data from a recording medium, and a function to write image data in a recording medium.

A function to read an image means an image reading apparatus called a film scanner which photoelectrically reads an image recorded in a developed negative film or reversal film, or a flat-bed scanner which reads a reflective original. By being provided with such an image reading apparatus, in an order based on a visible image (what is called an analogue image), the image is also converted into a digital signal, and can be obtained as digital image data.

A function to process digital image data means a function capable of various kinds of image processing such as compression, expansion [defreezing], and composition. Further, to explain it concretely, it means an apparatus which is capable of carrying out all kinds of processes relating to image processing, that is, not only reduction of plural images into an image by pasting and compression/expansion [defreezing], but also a layout processing such as pasting of character data, retouch processing which applies some treatment to an original image, filtering or edge processing for emphasizing the sharpness of an image, noise processing for controlling the feeling of ruggedness, color correction for correcting the color balance, the density correction processing, etc.

With respect to the various kinds of image processing, it is appropriate for the apparatus to have a function to carry out the processing automatically, or to have a function to carry out it manually by a software. Usually, image processing is carried out through a software for enabling it by a PC, but it is possible to use a hardware apparatus provided with also an image processing portion.

An apparatus which writes image data in a recording medium or reads out them from it means an apparatus having a function to write image data in a recording medium such as a magnetic recording medium (a floppy disk, a ZIP, and a DAT), a photo-thermal recording medium (a DC-R), a photomagnetic recording medium (MO), or a semiconductor medium (a PCMCIA card), or in a large-capacity recording device such as a hard disk.

Usually, it is desirable that an apparatus for exclusive use in writing data in the above-mentioned recording media is built in a PC or connected to it from the outside. For a concrete example of a writing device for the above-mentioned recording media, an MO drive, a ZIP drive, a DAT drive, a DVD-ROM drive, and a PCMCIA card throttle can be cited.

An apparatus capable of outputting prints of digital image data means an apparatus having a function to print out image data as a photographic print or a hard copy. With respect to the above-mentioned output apparatus, there is no restriction to it, but it may desirably be a digital printer using a silver halide photographic photosensitive material, a printer of the ink jet method, a thermal printer of the sublimation type, a thermal printer of the transfer type, a laser printer, a digital copying machine, etc. In particular, for the reason of a high image quality to be obtained, a digital printer using a silver halide photographic photosensitive material, an ink jet printer, or the like is desirable. These apparatus may be used as a plurality of them in serial connection, or as a single one out of them.

An image forming apparatus as described above needs to have means for making correspondence with the customer identifying information in putting this invention into practice. The means for making correspondence with the customer identifying information is an apparatus comprising means for inputting the customer identifying information which is required for inputting the customer identifying information obtained at the time of order reception and being used for letting the inputted customer identifying information correspond to the image data. By this correspondence making, it is possible to output also the customer identifying information simultaneously with the printout of the image.

In the case where the order is made through the network by a customer, because the customer inputs the customer identifying information directly, the correspondence making is done automatically, and efficiently. Further, to explain it concretely, in the case where prints are produced on the basis of the order received from the customer A, the customer identifying information such as the name and the address obtained from the customer A is inputted in correspondence with the customer ID by using a PC having a function to input the customer identifying information or the like. When the images ordered by the customer A are printed, if printing is done after the customer ID is inputted, whole of the customer identifying information is read out, and the items to meet the requirement are printed simultaneously with the prints including the objective image. The detail of the customer identifying information to be printed will be explained later.

An image forming apparatus as described above makes the print having the customer identifying information for identifying the customer recorded on it come to the uppermost position, with the recording surface of the prints made upside, at the time of making prints. In the drawing, 1 denotes the customer identifying information recorded on the uppermost print. Under the print having the customer identifying information 1 recorded on it, the main prints 2 are arranged.

By making such a structure, in the packing process S3, because the customer identifying information comes to the uppermost position in the order of the print arrangement, the prints can be packed as they are, and the print packing process is shortened, which is convenient.

In this specification, the above-mentioned recording surface of the prints means the surface enabling the visual confirmation of the image correctly, and usually, it is the surface of the recording medium on which an image is recorded by the recording means of the image forming apparatus. In the drawing, it is indicated by the surface enabling the correct confirmation of the customer identifying information, that is, the upside surface. The image forming apparatus used in this invention is capable of printing not only digital image data, but also various sorts of things such as character data, an illustration, and a template.

In this case, it is desirable that the apparatus for recording the customer identifying information 1 and the apparatus for recording the objective images are one and the same. In addition, the print including the customer identifying information for identifying the customer (hereinafter referred to also as the print for identifying the customer), and the print including the objective image (hereinafter referred to also as the main print) may be produced also by respective image forming apparatus, but it is not desirable because the arrangement processing of the prints becomes complex.

In the following, the arrangement processing will be explained in detail. In most cases, the prints are ejected and superposed on one another with the recording surface made upside, in order that the stains and scratches may not be put. Especially, in the case where a silver halide photographic photosensitive material is used for the prints, because the emulsion surface (called the gelatin surface) becomes the recording surface of the prints, it is easy to catch stains and scratches. In rare cases, for the reason of the structure of the machine, the recording surface of prints comes to downside, but it is done in the case of a laser printer or the like in which stains and scratches are difficult to put; therefore, it is not so much desirable to make the recording surface downside in the case of an ink jet printer or a printer for a silver halide photographic photosensitive material. In the arrangement processing of this invention, the arrangement must be made in such a way that the customer identifying information comes to the uppermost position, with the recording surface of the prints made upside.

For example, let us consider the case where prints based on the simultaneous print order from a negative film are made. The customer identifying information is inputted beforehand or just before the practice of printing operation, and the printing operation is started. In the case where the customer identifying information is inputted beforehand, the customer ID etc. indicating the customer are inputted before the printing operation is started. When the printing operation is started, at first, the objective images of the ordered film are printed. For example, in the case of 25 frame scene, printing for the 25 frames is started. At this time, if printing is begun with the frame having the largest frame number (25 in this case), the prints are very much easy to look at for the customer after they are finished, because they are arranged consecutively from the smallest frame number at the top.

The customer identifying information is printed last. Then, after they are ejected, the prints are arranged in such a way that the customer identifying information comes to the uppermost position as shown in FIG. 1. In the case of this image forming apparatus, the arrangement is made by an apparatus capable of ejecting prints with their recording surfaces facing up. Of course, in the case where the recording surfaces of the prints face down when they are ejected, the arrangement of the prints are reverse to that mentioned above; however, it does not spoil the effect of this invention.

Incidentally, for the customer identifying information, for example, the address, the name, the postal code number, the telephone number, the ID number, etc. can be considered; by using at least one of these bits of identifying information, the recognition of the customer can be reliably made.

Now, by recording, in addition to the customer identifying information, also at least one of the sender's address, name, postal code number, telephone number, and ID number, the recognition of the sender on top of the recognition of the customer can be made, which is more convenient.

Because one of the aim of the customer identifying information is to deliver the prints to the customer by mail etc., there are recorded the customer's name, address, telephone number, postal number, and the sender's address, name, telephone number, etc. Further, it is more desirable that there are recorded codes which are necessary for the control of goods such as the customer ID, the order number, the packing number, and the sender's code.

Figure 5:
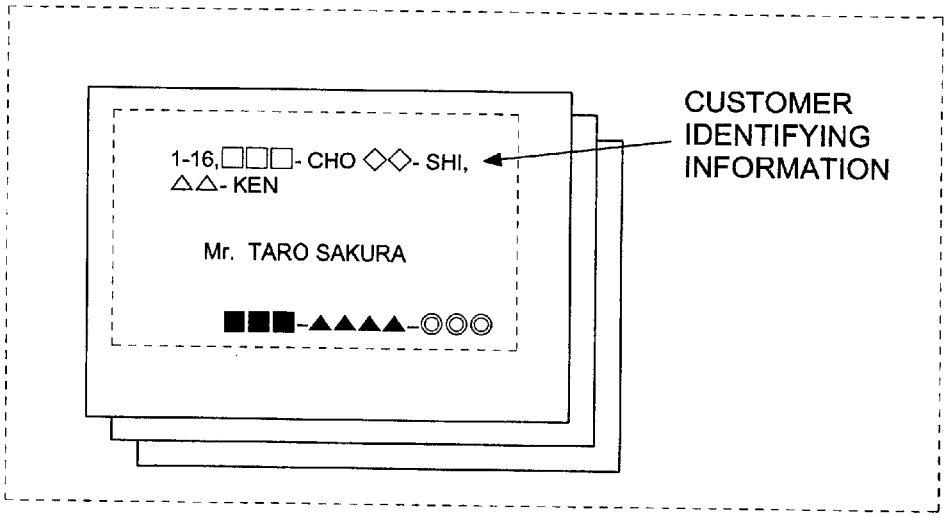
FIG. 5 is a drawing showing an example of a print including the customer identifying information according to this invention.

Even though these bits of information are recorded, it is not of direct merit for the customer; therefore, it is more desirable that they are recorded in bar codes or the like. If they are recorded in bar codes or the like, the control on the way of delivery etc. can be carried out by a bar code reader or the like, which is convenient. An example of it is shown in FIG. 5.

According to this invention, by making the print size of the print including the customer identifying information for identifying the customer larger than the print size of the image print (main print) including the objective image, for example, the groups of prints based on the respective orders can be visually discriminated from one another. Desirably, if the size of the print including the customer identifying information is approximately equivalent to the size of the packing container for packing, it can be contained smoothly.

Further, in the print including the customer identifying information for identifying the customer, identification color information for identifying the customer can be also included. In this case, the customer identifying information can be more reliably recognized. Further, according to this invention, because the customer identifying information can be visually confirmed, the address in the customer information can be easily recognized.

Further, as another way of utilization, for example, by recording the identification color information separately in accordance with the place of the customer's residence (address), the prints can be sorted automatically by means for discriminating the identification color information, which is effective.

Figure 2:
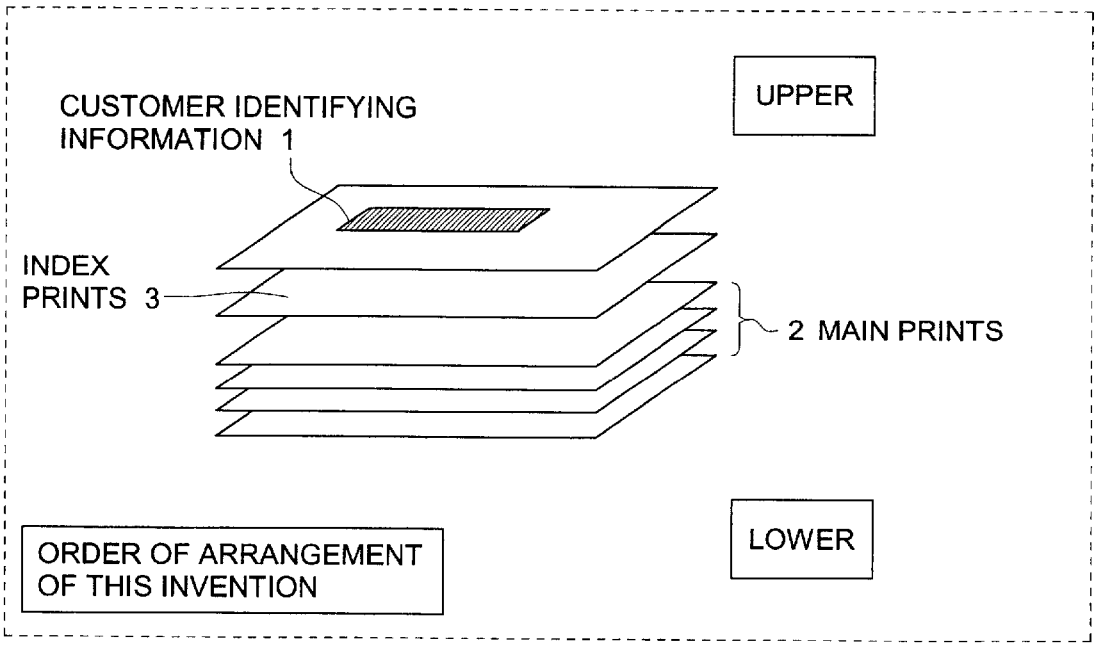
FIG. 2 is a drawing showing the order of arrangement of prints according to this invention.

FIG. 2 is a drawing showing the order of the arrangement of prints according to this invention. The same things as those in FIG. 1 are denoted by the same sign. The example of the embodiment shown in the drawing is the arrangement of prints in which the print including the customer identifying information 1 comes to the uppermost position, then comes next the index print 3 presenting the index of the prints, and under that come the main pints 2.

In this way, by making the customer identifying information come to the uppermost position in the order of the arrangement of prints, they can be packed as they are at the time of packing; therefore, the print packing process can be shortened, which is convenient. Further, by providing the index print 3 at the next place in the arrangement, it is possible to grasp the whole of the images.

Figure 3:
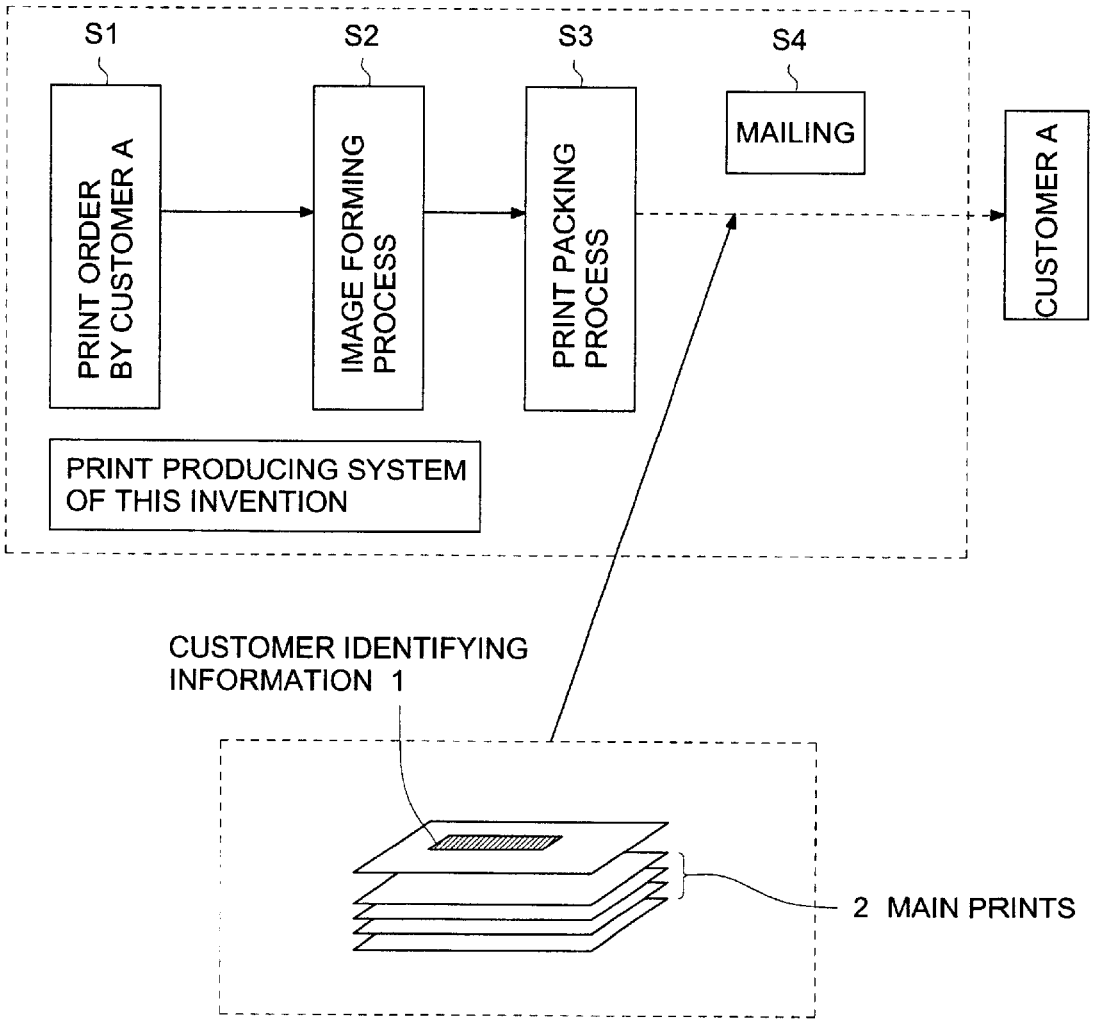
FIG. 3 is a drawing showing how the packed matter is mailed according to this invention.

FIG. 3 is a drawing showing how the packed matter is mailed according to this invention. The same things as those in FIG. 1 are denoted by the same sign. In this example, it is shown how the packed matter, which has been made to include the customer identifying information 1 at the uppermost position by the print packing process S3, is mailed to the customer A.

Figure 4:
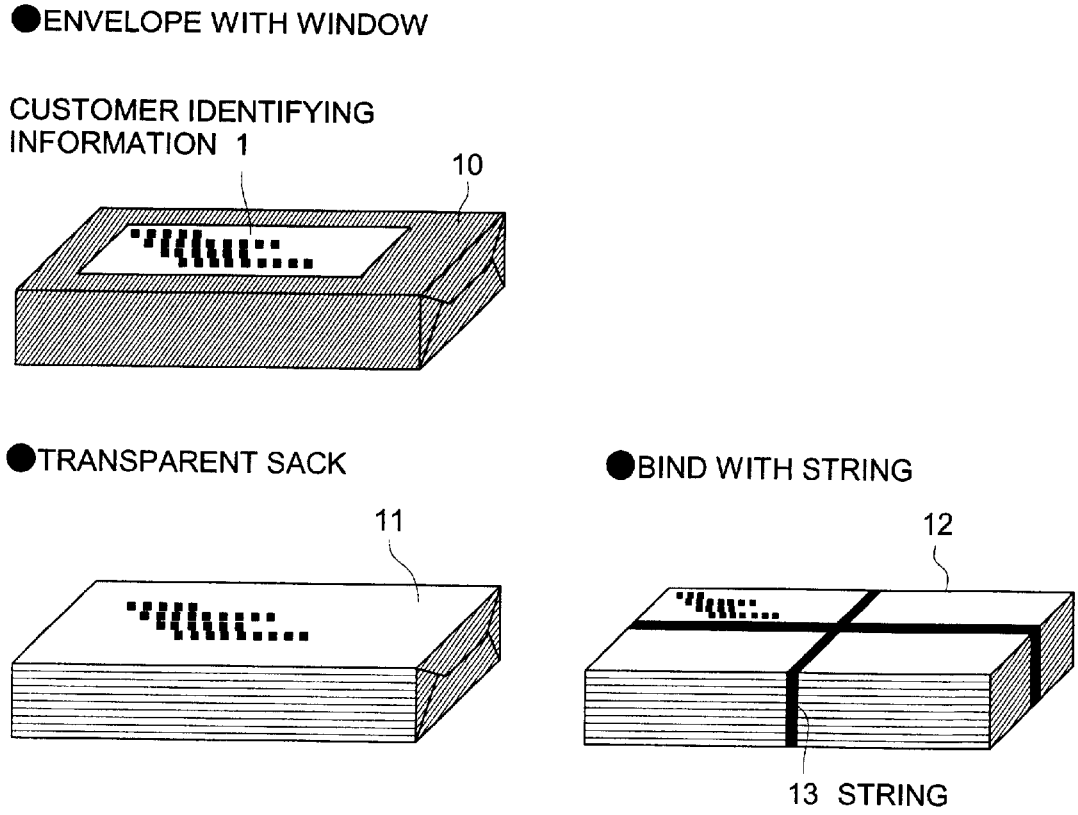
FIG. 4 is a drawing showing examples of the form of the packed matter.

FIG. 4 is a drawing showing an example of the form of the packed matter according to this invention. 10 denotes prints in the state of being contained in a envelope having a window. Through the front surface (window) of said packed matter 10, the customer identifying information 1 (the address of the customer) can be seen. Accordingly, the customer identifying information can be recognized visually, and in accordance with this customer identifying information, it can be mailed to the customer.

11 denotes the packed matter in the state of being contained in a transparent sack. By making the packed matter contained in a transparent sack, the address information 1 of the customer can be read from the outside. 12 denotes the packed matter in the state of being bound by the string 13. Because the customer identifying information 1 is recorded at the uppermost position of the packed matter, it can be mailed to the customer in accordance with this customer identifying information.

Further, it is desirable that a receipt print presenting billing information is included in the prints. A receipt print is one on which the content payable by the customer or the content paid by the customer is recorded, and mainly it comprises the basic rate, a print charge, a tax, a film development charge, etc. Further, in the case of digital image data, in addition to the above, it includes a technical charge, an expense for communication line. Of course, it is appropriate to record the charge content etc. for each of the charges concretely. In other cases, it includes the name, address, telephone number, name of transfer account, number of account of the person who requests or pays, because it has a possibility to be used instead of a bill or a receipt. With respect to the order of these sheet prints in the arrangement, in the case where no index print is present, there is no particular restriction so long as it is placed under the print including the customer identifying information; it is convenient for the customer when he looks at it, if the sheet prints are placed at the lowermost position, with the recording surface made upside. The merit of making the receipt print included in these prints is remarkable for the customer, and there is no need to state the detail.

FIG. 5 is a drawing showing an example of prints including the customer identifying information of this invention. For the customer identifying information, the postal code number, the address, the name, and the telephone number are recorded. If the prints are packed in the condition that the customer identifying information are recorded in the uppermost print, the prints are packed as they are and the print packing process is shortened, which is convenient.

As explained in detail in the foregoing, according to the present invention, such effects as described below can be obtained.

The order of arrangement of the prints, which are obtained by carrying out printing based on digital image data from a plurality of bits of print order information including the customer identifying information and packing by said print producing system, with the print recording surfaces made upside, is such one that the print including the customer identifying information for identifying the customer comes to the uppermost position of the prints; therefore, it is possible to make the uppermost print include the customer identifying information, which makes it possible to pack the prints as they are in the packing process; thus, the print packing process is shortened, and it is convenient.

The aforesaid print producing system further comprises a print image forming process for printing an image from the aforesaid print order information, and the order of arrangement of the prints, with the print recording surfaces made upside, is such one that the print including the customer identifying information for identifying the customer comes to the uppermost position of the prints; therefore, it is possible that the uppermost print includes the customer identifying information for identifying the customer, which makes it possible to pack the prints as they are in the packing process; therefore, the print packing process is shortened, and it is convenient.

The prints obtained by the aforesaid print image forming process are comprised of a print including the customer identifying information for identifying the customer, a print including the objective image which the customer has ordered, and an index-print, and the order of arrangement of the prints, with the print recording surfaces made upside, is such one that the print including the customer identifying information for identifying the customer comes to the uppermost position of the prints, the next is the index-print, and the next further and under are the image prints including the objective image; therefore, it is possible that the uppermost print includes the customer identifying information, which makes it possible to pack the prints as they are in the packing process; thus, the print packing process is shortened, and it is convenient. Further, because the index-print is placed next to the customer identifying information, the whole of the images can be quickly grasped.

The prints packed by the aforesaid print producing system are comprised of a print including the customer identifying information for identifying the customer, a print including the objective image which the customer has ordered, and an index-print, and the order of arrangement of the prints, with the print recording surfaces made upside, is such one that the print including the customer identifying information for identifying the customer comes to the uppermost position of the prints, the next is the index-print, and the next further and under are the image prints including the objective image; therefore, it is possible that the uppermost print includes the customer identifying information, which makes it possible to pack the prints as they are in the packing process; thus, the print packing process is shortened, and it is convenient. Further, because the index-print is placed next to the customer identifying information, the whole of the images can be quickly grasped.

The aforesaid print comprises at least one of the bits of the customer identifying information which indicates the identification of the customer; therefore, the address information of the customer can be quickly obtained, owing to it that the print has the customer identifying information.

The print size of the print including the aforesaid customer identifying information for identifying the customer is made larger than the print size of the image print including the objective image; therefore, in packing the prints, it can be done well, and by inserting a print identifying the customer for every order for example, the groups of prints can be recognized for the respective orders.

The aforesaid print including the customer information for identifying the customer includes identification color information for identifying the customer; therefore, the customer identifying information can be recognized more clearly.

The aforesaid customer identifying information for identifying the customer is at least one selected from the address, name, postal code number, telephone number of the customer, the ID number for identifying the customer and/or the order, the bar code for identifying the customer and/or the order; therefore, the recognition of the customer can be reliably done.

The aforesaid customer identifying information for identifying the customer is at least one selected from the address, name, postal code number, telephone number of the customer, the ID number for identifying the customer and/or the order, the bar code for identifying the customer and/or the order; therefore, the recognition of the customer can be reliably done.

On the print on which the aforesaid customer identifying information is recorded, at least one selected from the address, name, postal code, telephone number, and ID number of the sender is also recorded; therefore, in addition to the recognition of the customer, the recognition of the sender can be also made.

The image print including the objective image which the customer has ordered and the print including the customer identifying information for identifying the customer are produced by the same image forming apparatus; therefore, in addition to the image information, the customer identifying information can be recorded by the same image forming apparatus, which is convenient.

The way of packing in the aforesaid packing process, with the recording surface made upside, is such one that the print on which the customer identifying information is recorded can be visually confirmed; therefore, the address of the customer can be easily recognized, because the customer identifying information can be visually confirmed.

A receipt print presenting the billing information is included in the prints packed by the aforesaid print producing system; therefore, the billing information can be known.

As described in the foregoing, according to the present invention, it is possible to provide a print producing system and prints which are capable of solving the troubles as described above and delivering the prints reliably to the customer more efficiently by a simple process.

What is claimed is:

1. A print producing system comprising:

an inputting section to input a plurality of print-order information including customer-identifying information for identifying each of a plurality customers; and a single print-producing section, coupled to said inputting section for receipt of said print-order information, to produce a package of prints including an uppermost first print having said customer-identifying information printed on an upward surface of said first print, and a plurality of second prints disposed under said first print and comprising images based on digital image data corresponding to said print-order information.

2. The system of claim 1, wherein said order of said first print and said second prints is obtained by controlling a printing order of said prints.

3. The system of claim 1, wherein said print-producing section comprises a first print-producing part for producing said first print and a second print-producing part for producing said second prints, and said order of said prints is obtained by controlling a printing order of said first print-producing part and said second print-producing part.

4. The system of claim 3, wherein said first print-producing part produces said first print after said second print-producing part produces said second prints, and said first print is discharged in such a manner that a printed surface of said first print faces upward.

5. The system of claim 1, wherein said prints, produced by said print-producing section, also include an index-print which is automatically arranged in said order of said prints so that said index print is disposed between said first print and said second prints.

6. The system of claim 1, wherein a print size of said first print is larger than a print size of said second prints.

7. The system of claim 1, wherein said first print includes color-identifying information for identifying each of said customers.

8. The system of claim 1, wherein said customer-identifying information, for identifying each of said customers, includes at least one of an address, a name, a postal code number, a telephone number of each of said customers, an ID number for identifying each of said customers and/or each of said print-order information, and a bar code for identifying each of said customers and/or each of said print-order information.

9. The system of claim 1, wherein at least one of items selected from an address, a name, a postal code number, a telephone number, and an ID number of a sender is written on said first print.

10. The system of claim 1, wherein a same image forming apparatus produces said first print and said second prints.

11. The system of claim 1, further comprising:

a packing section to pack said prints, arranged in said order by said print producing section, in such a manner that the printed surface of said first print can be visually recognized.

12. The system of claim 1, wherein said prints also include a printed receipt on which billing information is written.

* * * * *